United States Patent [19]

Ito et al.

[11] Patent Number: 4,672,270

[45] Date of Patent: Jun. 9, 1987

[54] METAL VAPOR DISCHARGE LAMP HAVING A STARTING DEVICE OF A THERMAL SWITCH TYPE

[75] Inventors: Akira Ito; Kouzou Kawashima, both of Yokohama, Japan

[73] Assignee: Tokyo Shibaura Denki Kabushiki Kaisha, Kawasaki, Japan

[21] Appl. No.: 594,316

[22] Filed: Mar. 28, 1984

[30] Foreign Application Priority Data

Mar. 30, 1983 [JP] Japan ..... 58-52685

[51] Int. Cl.[4] ..... H01J 7/44; H01J 17/20; H01J 17/34; H01J 19/78

[52] U.S. Cl. ..... 315/73; 315/74; 315/75; 315/47; 315/119; 315/106; 313/568; 313/570; 313/573; 313/637

[58] Field of Search ..... 315/119, 73, 74, 47, 315/290, 75, 106, 340; 313/568, 570, 638, 573, 643; 362/164

[56] References Cited

U.S. PATENT DOCUMENTS

| | | | |
|---|---|---|---|
| 4,135,114 | 1/1979 | Narikiyo | 315/73 |
| 4,143,301 | 3/1979 | Strauss et al. | 315/73 |
| 4,208,614 | 6/1980 | Strauss et al. | 315/73 |
| 4,344,081 | 8/1982 | Inada | 315/73 |
| 4,431,945 | 2/1984 | Kawashima et al. | 315/73 |
| 4,433,272 | 2/1984 | Ogawa | 315/73 |
| 4,481,446 | 11/1984 | Tsuchihashi et al. | 315/73 |

FOREIGN PATENT DOCUMENTS

| | | | |
|---|---|---|---|
| 3015451 | 10/1980 | Fed. Rep. of Germany . | |
| 0122351 | of 1979 | Japan | 315/73 |
| 0030111 | 3/1980 | Japan | 315/73 |
| 0124941 | 9/1980 | Japan | 315/73 |
| 267753 | 2/1970 | U.S.S.R. | 315/74 |

*Primary Examiner*—David K. Moore
*Assistant Examiner*—M. Razavi
*Attorney, Agent, or Firm*—Cushman, Darby & Cushman

[57] ABSTRACT

A metal vapor discharge lamp has a burner for sealing xenon gas, mercury and a light-emitting additive in a translucent ceramic tube, a starting device of a thermal switch type which has a series circuit of a thermal switch and a coil filament and which is connected in parallel with the burner, and an outer envelope for sealing the burner and the starting device therein. In the lamp, the following inequalities must be satisfied:

$$13.3 \leqq P \cdot (B/A) \leqq 665$$

$$0.05 \leqq d \leqq 0.12$$

$$2{,}200 \leqq T \leqq 2{,}800$$

where A is the volume ($cm^3$) of the outer envelope, B is the volume ($cm^3$) of the burner, P is a gas pressure (Pa) at room temperature of xenon sealed in the burner, d is a diameter (mm) of the coil filament, and T is a temperature (K) of the coil filament during operation.

5 Claims, 3 Drawing Figures

METAL VAPOR DISCHARGE LAMP HAVING A STARTING DEVICE OF A THERMAL SWITCH TYPE

BACKGROUND OF THE INVENTION

The present invention relates to a metal vapor discharge lamp having a starting device of a thermal switch type.

Inside a metal vapor discharge lamp having an arc tube or burner such as a high pressure sodium lamp, mercury Hg and sodium are sealed together with an inert gas for starting. As Xenon (Xe) has a small thermal conduction loss and is capable of increasing luminous efficacy, it is generally used as an inert gas for starting. However, unlike the case where argon (Ar) is used, a Penning effect does not occur between Hg and Xe. As a result, the starting voltage of the burner is increased, and the burner cannot start with a commercial power supply voltage. In order to turn on a high pressure sodium lamp of this type, a ballast, having an expensive starting device for generating a high voltage pulse, is required.

On the other hand, a high pressure sodium lamp that can be started by even an inexpensive mercury lamp ballast has recently been developed. This lamp comprises: a burner; a starting device of the thermal switch type, which is constituted by a series circuit of a thermal switch and a coil filament and which is connected in parallel with the burner; and an outer envelope for hermetically sealing the burner and starting device inside the lamp. An outside auxiliary conductor is disposed in contact with a tube wall of the burner to decrease the required starting voltage. In a lamp of this type, if the burner develops a leak toward the end of its service life, xenon, mercury and sodium will leak out of the burner into the outer envelope, which maintains a high vacuum. When the power switch is turned on and power is supplied to the lamp while a gas pressure of xenon, leaking into the outer envelope, is held to be not less than 13.3 Pa (0.1 torr), the starting device is actuated to generate a pulse, and the burner may be turned on. In this case, the large amount of mercury sealed in the burner leaks into the outer envelope, and the lamp voltage will not be increased. Therefore, a current similar to a short circuit current flowing through the secondary side of the ballast flows through the ballast, possibly overheating the ballast.

Japanese Laid Open Publication No. 55-122351 discloses a means for causing a discharge in the outer envelope to melt and disconnect a coil filament so that a high voltage pulse, generated from the starting device while there is leakage from the burner, will not be applied to the ballast to break down the ballast. The coil filament of the starting device of a thermal switch type is held at a temperature of 1873 K. (1,600° C.) or higher during its operation. If the burner leaks, xenon in the outer envelope is ionized by the thermo electrons produced from the coil filament, so that a discharge occurs in the outer envelope with the coil filament acting as an electrode. By this discharge, the coil filament is melted and disconnected.

However, according to the prior art described above, the coil filament can be melted and disconnected only when the xenon pressure in the outer envelope exceeds 26.6 Pa (0.2 torr). As described above, the burner tends to be turned on in accordance with a kick voltage generated upon operation of the thermal switch even if the xenon pressure in the outer envelope is less than 26.6 Pa. In general, the on/off operation of the thermal switch can be performed only once every 2 to 3 seconds. When the lamp is installed at a place (e.g., in the vicinity of mechanical equipment or traffic) where vibration occurs, the contact of the thermal switch tends to vibrate and turn the switch on/off about 10 times per second. In this condition, the lamp is turned on, and the coil filament will neither be melted nor disconnected even if the gas pressure of xenon leaking into the outer envelope has not reached 26.6 Pa. As a result, the ballast is damaged due to overheating.

Another problem of the conventional lamp lies in the fact that it takes a long time to melt and disconnect a coil filament even after the temperature of the coil filament exceeds 1,600° C. In this case, the thermal switch tends to be turned on before the coil filament reaches a temperature high enough for it to be melted and disconnected. When the gas pressure of xenon, leaking into the outer envelope, exceeds 13.3 Pa, the lamp is turned on. As a result, the damaging of the ballast due to overheating cannot be completely prevented.

SUMMARY OF THE INVENTION

It is an object of the present invention to provide a metal vapor discharge lamp capable of preventing overheating and damaging of a ballast by completely melting and disconnecting a coil filament of the thermal switch type which is sealed in an outer envelope, when a leak occurs in a burner.

In order to achieve the above object of the present invention, there is provided a metal vapor discharge lamp comprising:

burner means having a translucent ceramic tube, a pair of electrodes each arranged at one end of said tube, a starting gas sealed in said tube, and containing xenon as a major constituent, mercury and an additive for light emission;

starting means having a coil filament and a switch connected in series with said coil filament, which operates in response to heat generated from said coil filament, said starting means being connected in parallel with said pair of electrodes of said burner means to start said burner means; and outer envelope means for hermetically sealing said burner means and said starting means and supplying power thereto, wherein the following inequalities are satisfied:

$$13.3 \leqq P \cdot (B/A) \leqq 665$$

$$0.05 \leqq d \leqq 0.12$$

$$2{,}200 \leqq T \leqq 2{,}800$$

where A is a volume ($cm^3$) of said outer envelope means, B is a volume ($cm^3$) of said burner means, P is a gas pressure (IPa) at room temperature of xenon sealed in said burner means, d is a diameter (mm) of said coil filament, and T is a temperature (K) of said coil filament during operation.

More preferably, the coil filament can be quickly and properly melted and disconnected when the following inequalities are satisfied:

$$13.3 \leqq P \cdot (B/A) \leqq 665$$

$$0.05 \leqq d \leqq 0.10$$

$2{,}300 \leqq T \leqq 2{,}800$

BRIEF DESCRIPTION OF THE DRAWINGS

Other objects and advantages of the present invention will be apparent from the following description taken in conjunction with the accompanying drawings in which.

DETAILED DESCRIPTION OF THE PREFERRED EMBODIMENT

Figure 1:
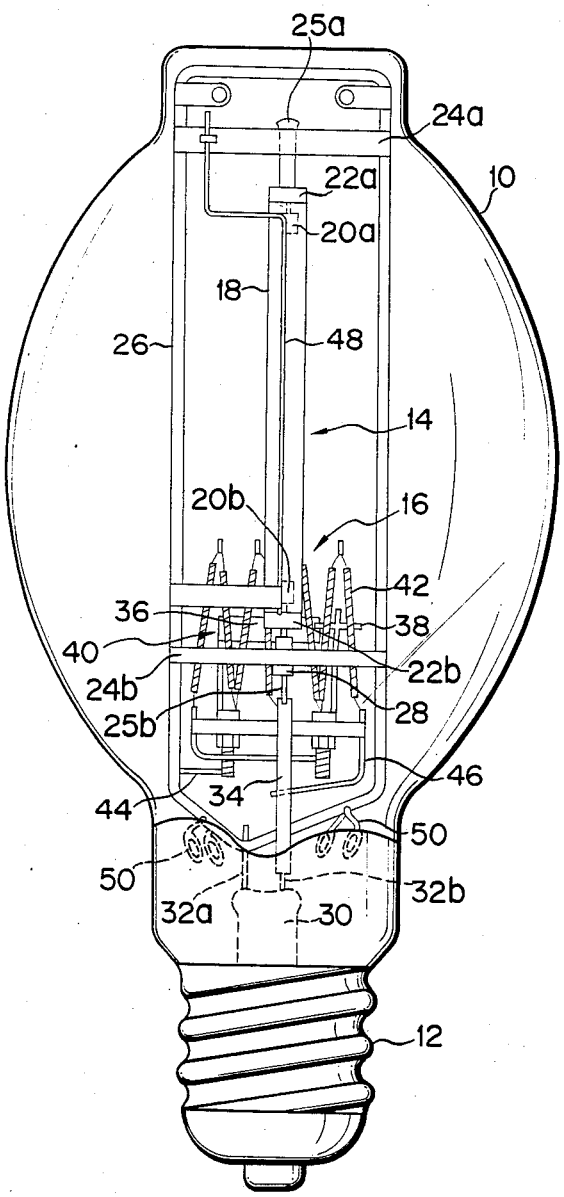
FIG. 1 is a schematic view of a high pressure sodium lamp of the present invention.
Figure 2:
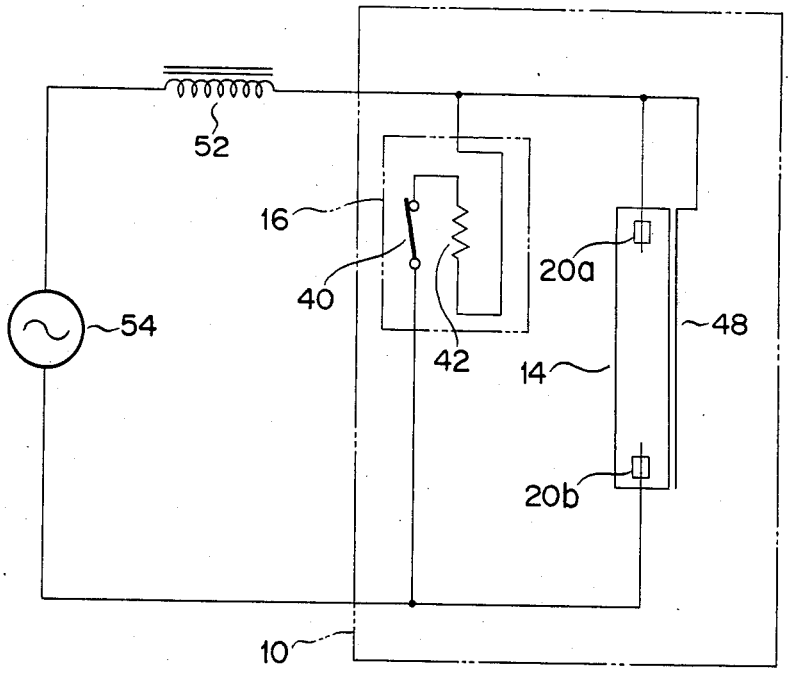
FIG. 2 is a circuit diagram showing the high pressure sodium lamp of the present invention and a starting device thereof.
Figure 3:
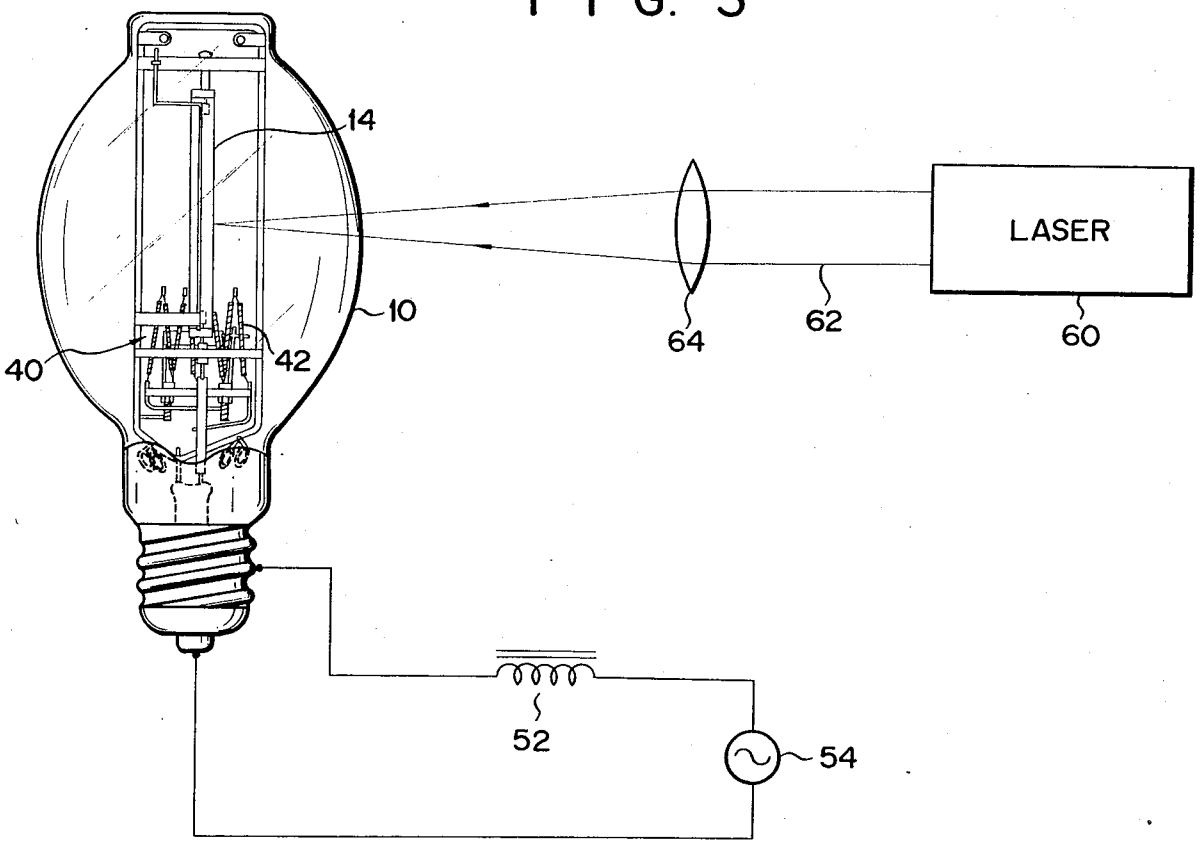
FIG. 3 is a schematic view of an experimental apparatus for realizing the present invention.

A high pressure sodium lamp according to the present invention will be described with reference to FIGS. 1 and 2.

An inner space of an outer envelope 10 maintains a high vacuum, and a base 12 is mounted at one end of the outer envelope 10. A burner 14 and a starting device 16 of a thermal switch type, connected in parallel with the burner 14, are hermetically sealed within the outer envelope 10. The burner 14 comprises a translucent alumina ceramic tube 18, a pair of electrodes **20*a* and 20*b* arranged one at each end of the alumina ceramic tube 18, and a pair of sealing members 22*a* and 22*b* mounted by a glass solder at both ends of the tube 18 to support the electrodes 20*a* and 20*b* respectively and to hermetically seal the tube 18. The sealing members 22*a* and 22*b* are made of alumina. A starting xenon gas with a pressure of $2.66 \times 10^4$ Pa, and 30 mg of sodium-mercury amalgam containing 15 wt % of sodium are sealed in the burner 14. A niobium metal exhaust tube 25*a* is hermetically sealed at the central portion of the sealing member 22*a*. The metal exhaust tube 25*a* is held by a holder 24*a*, and the holder 24*a* is fixed by a support wire 26. An niobium metal wire 25*b* extends from the center of the sealing member 22*b* and is hermetically sealed. The metal wire 25*b* is held by a holder 24*b* through insulating ceramic 28, and the holder 24*b* is fixed on the support wire 26. The support wire 26 is mounted on a lead-in wire 32*a* of a stem 30. The niobium metal wire 25*b* is connected to a lead-in wire 32*b* of the stem 30 through a nickel ribbon 34. The starting device 16 comprises: a thermal switch 40 consisting of a bimetal 36 and a contact 38; and a coil filament 42 consisting of a single coil connected in series with the thermal switch 40. One end of the bimetal 36 is connected to the support wire 26 through a wire 44. One end of the coil filament 42 is connected to the nickel ribbon 34 through a wire 46. The bimetal 36, the contact 38 and the coil filament 42 constitute a series circuit. The lead-in wires 32*a* and 32*b* are connected to an eyelet and a shell of the base 12, respectively. An outside auxiliary conductor 48 made of molybdenum or tantalum is disposed in contact with the outer surface of the burner 14 to ease starting. Barium getters 50 are disposed in the outer envelope 10 and are held at a pressure of at least $1.33 \times 10^{-2}$ Pa in the outer envelope 10. A current-limiting resistor can be added to the starting device 16** as needed.

The high pressure sodium lamp having the construction described above is connected to an AC power supply 54 through a mercury lamp ballast of single choke type or choke coil 52 and can be turned on. The thermal switch 40 is closed before the burner 14 is started, so that a current flows through the coil filament 42. The thermal switch 40 is opened by heat generated by a current flow. A high kick voltage (high voltage pulse) appears across the two ends of the choke coil 52 due to an abrupt change in current, while the thermal switch 40 is opened. This high voltage pulse is applied between the electrodes **20*a* and 20*b* of the burner 14, so that the high pressure sodium lamp is started. Since the outside auxiliary conductor 48 is in contact with the outer surface of the burner 14, an abrupt potential gradient occurs between the outside auxiliary conductor 48 and the electrode 20*b*. This potential difference allows the burner 14** to be easily started.

If a leak should occur in the burner 14 in the prior art, xenon gas leaks into the outer envelope 10. In this state, when voltage is applied to the lamp, the lamp is turned on under the given conditions as previously described, and the coil filament 42 will not melt and disconnect. A current close to a short circuit current flows through the ballast 52, so that the ballast is burnt out or damaged.

The present inventors carried out the following experiment to determine the conditions for properly melting and disconnecting the coil filament 42 if the burner 14 develops a leak. The volume A of the outer envelope 10 of the high pressure sodium lamp was 1,200 $cm^3$, and the volume B of the burner 14 was 4.0 $cm^3$. The following three variables were given as follows:

(a) diameter d (mm) of the coil filament 42

(b) temperature T (K) of the coil filament 42 during operation (c) gas pressure P (Pa) of xenon sealed in the burner 14.

When a leak occurs in the burner 14, the resultant Xe gas pressure in the outer envelope 10 is given to be $P \cdot (B/A)$ according to item (c).

It should be noted that the diameter d (mm) in item (a) was varied to be 0.05 mm, 0.08 mm, 0.12 mm, 0.14 mm and 0.17 mm, and that the temperature T (K) in item (b) was varied to be 2,000 K, 2,200 K, 2,500 K and 2,800 K for each value of the diameter d (mm). The Xe gas pressure in the burner 14 was varied to be $3.99 \times 10^3$ Pa (13.3 Pa), $2.00 \times 10^4$ Pa (66.5 Pa), $3.99 \times 10^4$ Pa ($1.33 \times 10^2$ Pa), $1.20 \times 10^5$ Pa ($3.99 \times 10^2$ Pa), and $2.00 \times 10^5$ Pa ($6.65 \times 10^2$ Pa). Values in parentheses indicate the resultant Xe gas pressure $P \cdot (B/A)$ within the outer envelope 10 when leakage occurred from the burner 14.

In accordance with the values of the three variables described above, lamps having twenty starting devices 16, according to the twenty different combinations of the above values for the diameter d of the coil filament 42 and the temperature T, were prepared for each of the five types of burners 14 having different Xe gas pressures from each other. A laser beam 62 generated from a laser oscillator 60 was used to irradiate each burner 14 through a lens 64 to form an aperture in the burner 14 without impairing the corresponding outer envelope, so that Xe gas sealed in the burner 14 could leak into the outer envelope 10. An AC voltage of 200 V from the AC power supply 54 was applied to each lamp through the ballast 52 to check whether or not the corresponding coil filament 42 was melted and disconnected by a discharge in the outer envelope before the thermal switch 40 was operated. Results are shown in Tables 1 to 5.

TABLE 1

| Xe Pressure in Outer Envelope (13.3 Pa) | | Filament Diameter (mm) | | | | |
|---|---|---|---|---|---|---|
| | | 0.05 | 0.08 | 0.12 | 0.14 | 0.17 |
| Filament Temperature (K.) | 2000 | Δ | Δ | Δ | x | x |
| | 2200 | o | o | o | Δ | x |
| | 2500 | o | o | o | Δ | x |
| | 2800 | o | o | o | o | Δ |

TABLE 2

| Xe Pressure in Outer Envelope (66.5 Pa) | | Filament Diameter (mm) | | | | |
|---|---|---|---|---|---|---|
| | | 0.05 | 0.08 | 0.12 | 0.14 | 0.17 |
| Filament Temperature (K.) | 2000 | Δ | Δ | Δ | Δ | x |
| | 2200 | o | o | o | Δ | Δ |
| | 2500 | o | o | o | Δ | Δ |
| | 2800 | o | o | o | o | o |

TABLE 3

| Xe Pressure in Outer Envelope (133 Pa) | | Filament Diameter (mm) | | | | |
|---|---|---|---|---|---|---|
| | | 0.05 | 0.08 | 0.12 | 0.14 | 0.17 |
| Filament Temperature (K.) | 2000 | o | o | Δ | Δ | Δ |
| | 2200 | o | o | o | Δ | Δ |
| | 2500 | o | o | o | o | Δ |
| | 2800 | o | o | o | o | o |

TABLE 4

| Xe Pressure in Outer Envelope (399 Pa) | | Filament Diameter (mm) | | | | |
|---|---|---|---|---|---|---|
| | | 0.05 | 0.08 | 0.12 | 0.14 | 0.17 |
| Filament Temperature (K.) | 2000 | o | o | o | Δ | Δ |
| | 2200 | o | o | o | o | Δ |
| | 2500 | o | o | o | o | o |
| | 2800 | o | o | o | o | o |

TABLE 5

| Xe Pressure in Outer Envelope (665 Pa) | | Filament Diameter (mm) | | | | |
|---|---|---|---|---|---|---|
| | | 0.05 | 0.08 | 0.12 | 0.14 | 0.17 |
| Filament Temperature (K.) | 2000 | o | o | o | Δ | Δ |
| | 2200 | o | o | o | o | Δ |
| | 2500 | o | o | o | o | o |
| | 2800 | o | o | o | o | o |

Referring to Tables 1 to 5, symbol o indicates that the coil filament 42 was melted and disconnected by a discharge in the outer envelope 10 before the thermal switch 40 was operated at which time a voltage was applied to the lamp. Symbol Δ indicates that the coil filament 42 was melted and disconnected after the thermal switch 40 was operated several times. Symbol x indicates that the coil filament 42 was not melted and disconnected, and the burner 14 was turned on even after the thermal switch 40 was operated for 10 minutes. In accordance with the results in Tables 1 to 5, the conditions for symbol o to be obtained (i.e., the coil filament 42 to be properly melted and disconnected when a voltage is applied to the lamp while a leak is present in the burner 14) are given as follows:

13.3≦Xe gas pressure P·(B/A) (Pa) in the outer envelope≦665

0.05≦coil filament diameter d (mm)≦0.12

2,200≦temperature T (K) of the coil filament during operation≦2,800 (1)

When the diameter d of the coil filament 42 is less than 0.05 mm, the coil filament 42 tends to become disconnected, and handling of the coil filament 42 is difficult. As a result, the coil filament 42 is very difficult to manufacture. When the temperature T (K) of the coil filament 42 during operation exceeds 2,800 K, tungsten as a material of the filament wire is abruptly evaporated, thus shortening the service life of the coil filament 42. In addition, in consideration of the sealed Xe gas pressure in the burner and the volume of the outer envelope, the xenon gas pressure in the outer envelope cannot exceed 665 Pa. Therefore, the above conditions are excluded from the experiment.

When a lamp is manufactured in accordance with the allowable conditions in item (1) above, the coil filament 42 can be properly melted and disconnected. In particular, even if the xenon gas pressure leaked into the outer envelope does not reach 26.6 Pa, a discharge occurs in the outer envelope since the temperature of the coil filament 42 is high. Therefore, thermo electrons can be sufficiently generated from the coil filament 42, and since the diameter d of the coil filament is very thin, an arc spot can be properly formed on terminal of the coil filament 42. As a result, the coil filament 42 can be melted and disconnected. In particular, when the lamp is mounted at a place subject to vibration, this effect is great. In addition, when the Xe gas pressure exceeds 26.6 Pa, the coil filament 42 can be properly melted and disconnected within a short period of time because the coil diameter d is small. Unlike the conventional lamp, the lamp will not be turned on by the operation of the thermal switch 40, thereby preventing overheating and hence damaging of the ballast. This is because the short circuit current continues to flow through the ballast to overheat and damage the ballast unless the lamp is de-energized after the burner 14 is turned on.

In order to more properly melt and disconnect the coil filament 42, the following conditions must be satisfied:

$$13.3 \leqq P \cdot (B/A) \leqq 665$$

$$0.05 \leqq d \leqq 0.10$$

$$2{,}300 \leqq T \leqq 2{,}800 \quad (2)$$

This is because the coil filament can be properly melted and disconnected very quickly when the temperature of the coil filament 42 is increased and the diameter d of the coil filament is decreased.

The present invention is not limited to the particular embodiment described above. For example, any starting inert gas which contains xenon as a major constituent can be used to obtain the same effect as in the above embodiment. For example, less than 10% of other inert gases such as Ne or Ar can be added to xenon. In addition, the burner 14 is not limited to the alumina ceramic tube. For example, a translucent sapphire tube can be used. Furthermore, the additive to be sealed in the burner 14 is not limited to the sodium-mercury amalgam. Another additive such as a metal halide may be used in place of the sodium-mercury amalgam. The present invention can be applied to a metal halide lamp as well as to the high pressure sodium lamp. In addition to these modifications, the shape of the coil filament 42 can be selected as needed. The coil filament may comprise a single coil, a double coil or a triple coil.

What is claimed is:

1. A metal vapor discharge lamp, comprising:

burner means for producing a discharge, including (a) a translucent ceramic tube having two ends, (b) a pair of electrodes arranged at said ends of said tube, (c) means for sealing said ends of said tube, and (d) a starting gas sealed in said tube and including xenon as a major constituent thereof, mercury, and an additive for light emission;

starting means for starting said burner means including (a) a coil filament, and (b) switch means, connected in series with said coil filament for operating in response to heat generated from said coil filament, said starting means being connected in parallel with said pair of electrodes of said burner means to start said burner means; and outer envelope means for hermetically sealing said burner means and said starting means therewithin, and for supplying power thereto, said outer envelope means being maintained below $13.3\times10^{-2}$ Pa;

wherein the following inequalities are satisfied:

$$13.3 \leqq P\cdot(B/A) \leqq 665$$

$$0.05 \leqq d \leqq 0.12$$

$$2{,}200 \leqq T \leqq 2{,}800$$

where a is a volume in $cm^3$ of said outer envelope means, B is a volume in $cm^3$ of said burner means, P is a gas pressure in Pa at room temperature of xenon sealed in said burner means, d is a diameter in mm of said coil filament, and T is a temperature in degrees Kelvin of said coil filament during operation, whereby, when a leak occurs in said burner means and power is supplied to said coil filament, said coil filament emits thermal electrons to bring about a gas discharge in said outer envelope means, thereby causing said coil filament to melt and disconnect.

2. A lamp, according to claim 1, wherein the starting gas contains at least 90% of xenon gas.

3. A lamp, according to claim 1, wherein said additive comprises sodium.

4. A lamp, according to claim 1, wherein said additive comprises a metal halide.

5. A metal vapor discharge lamp, comprising:

burner means for causing a vapor discharge having a translucent ceramic tube, a pair of electrodes arranged respectively at ends of said tube, means for sealing the ends of said tube, and a starting gas sealed in said tube which includes xenon as a major constituent, mercury, and an additive for light emission;

starting means having a coil filament and a switch connected in series with said coil filament, and operating in response to heat generated from said coil filament, said starting means being connected in parallel with said pair of electrodes of said burner means for starting said burner means; and outer envelope means for hermetically sealing said burner means and said starting means therewith, and for supplying power thereto, said outer envelope means being maintained below $13.3\times10^{-2}$ Pa, wherein the following inequalities are satisfied:

$$13.3 \leqq p\cdot(B/A) \leqq 665$$

$$0.05 \leqq d \leqq 0.10$$

$$2{,}300 \leqq T \leqq 2{,}800$$

where A is a volume in $cm^3$ of said outer envelope means, B is a volume in $cm^3$ of said burner means, P is a gas pressure in Pa at room temperature of xenon sealed in said burner means, d is a diameter in mm of said coil filament, and T is a temperature in degrees Kelvin of said coil filament during operation, whereby, when a leak occurs in said burner means and power is supplied to said coil filament, said coil filament emits thermal electrons to bring about a gas discharge in said outer envelope means, thereby causing said coil filament to melt and disconnect.

* * * * *